US006183292B1

(12) United States Patent
Chen et al.

(10) Patent No.: US 6,183,292 B1
(45) Date of Patent: Feb. 6, 2001

(54) SHIELDED MODULAR JACK

(75) Inventors: Wayne Chen, Chia-I; Gordon Chew, Shin-Lin; Fu-Hua Feng, Hsin-Dan; Chin-Hao Li, Tan-Swei; Chin-Shan Yuan, Yung-Ho; Daniel Wu, Hsi-Chih, all of (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/415,103

(22) Filed: Oct. 6, 1999

(30) Foreign Application Priority Data

Jun. 1, 1999 (TW) ..... 88208874

(51) Int. Cl.[7] ..... H01R 13/60
(52) U.S. Cl. ..... 439/541.5; 439/607
(58) Field of Search ..... 439/541.5, 607, 439/609, 79, 76.1, 620

(56) References Cited

U.S. PATENT DOCUMENTS 5,069,641 * 12/1991 Sakamoto et al. ..... 439/620
5,085,590 * 2/1992 Galloway ..... 439/541.5
5,587,884 * 12/1996 Raman ..... 439/620
5,637,015 * 6/1997 Tan et al. ..... 439/609
5,647,766 * 7/1997 Nguyen ..... 439/620
5,647,767 * 7/1997 Scheer et al. ..... 439/676
5,851,125 * 12/1998 Hsu et al. ..... 439/541.5

* cited by examiner

*Primary Examiner*—Gary F. Paumen
(74) *Attorney, Agent, or Firm*—Wei Te Chung

(57) ABSTRACT

A modular jack comprises a dielectric frame, a daughter board having a RJ45 connector and a transformer mounted thereon, a stacked USB connector, and first and second shields enclosing the frame and the daughter board. The daughter board provides a grounding pad on a surface thereof on which the RJ45 connector is mounted. The stacked USB connector has a grounding shell mounted on a rear portion thereof. The stacked USB connector and the RJ45 connector together with the daughter board and the transformer are secured in the frame with the grounding pad of the daughter board electrically connected with the grounding shell of the stacked USB connector.

1 Claim, 4 Drawing Sheets

SHIELDED MODULAR JACK

BACKGROUND OF THE INVENTION

The present invention relates to a modular jack, and particularly to a modular jack exhibiting excellent grounding capabilities.

DESCRIPTION OF THE PRIOR ART

As the trend of the computer industry leads toward miniaturization, electrical connectors of reduced size are desired. Conventional modular jacks disclosed in U.S. Pat. Nos. 5,069,641; 5,587,884; and 5,647,766 provide a port for receiving a mating connector. However, such modular jacks are not suitable for high capacity signal transfer applications. U.S. Pat. No. 5,647,767 discloses a modular jack having three stacked ports to promote high capacity signal transfer. However, the modular jack does not provide an effective grounding shield for preventing cross-talk. Hence, an improved electrical connector is required to overcome the disadvantages of the prior art.

BRIEF SUMMARY OF THE INVENTION

A first object of the present invention is to provide a modular jack comprising at least an RJ45 connector and a stacked USB connector;

A second object of the present invention is to provide a modular jack exhibiting excellent grounding capabilities.

Accordingly, a modular jack comprises a dielectric frame, a daughter board having a RJ45 connector and a transformer mounted thereon, a stacked USB connector and first and second shields enclosing the frame and the daughter board. The daughter board includes a grounding pad on a surface thereof on which the RJ45 connector is mounted. The stacked USB connector has a grounding shell mounted on a rear portion thereof. The frame forms a horizontal partition and a vertical partition. The frame defines a first space and a second space separated by the horizontal partition. The vertical partition defines a slot. The first and stacked USB connectors are received in the first and second spaces, respectively, with the daughter board abutting against the vertical partition and the grounding pad extending through the slot to electrically connect with the grounding shell of the stacked USB connector.

The first shield comprises a rear plate and a pair of side plates. The rear plate defines a slit proximate a top edge thereof. Each side plate forms a pair of bosses proximate an edge thereof distanced from the rear plate. The second shield comprises a top plate and a front plate. The top plate forms a hook downwardly extending from an edge thereof distanced from the front plate. The front plate defines a pair of cutouts in each opposite side edge thereof. The hook is received in the slit and the cutouts receive the corresponding bosses to engage the first and second shields together.

Other objects, advantages and novel features of the invention will become more apparent from the following detailed description of the present embodiment when taken in conjunction with the accompanying drawings.

DETAILED DESCRIPTION OF THE INVENTION

Figure 1:
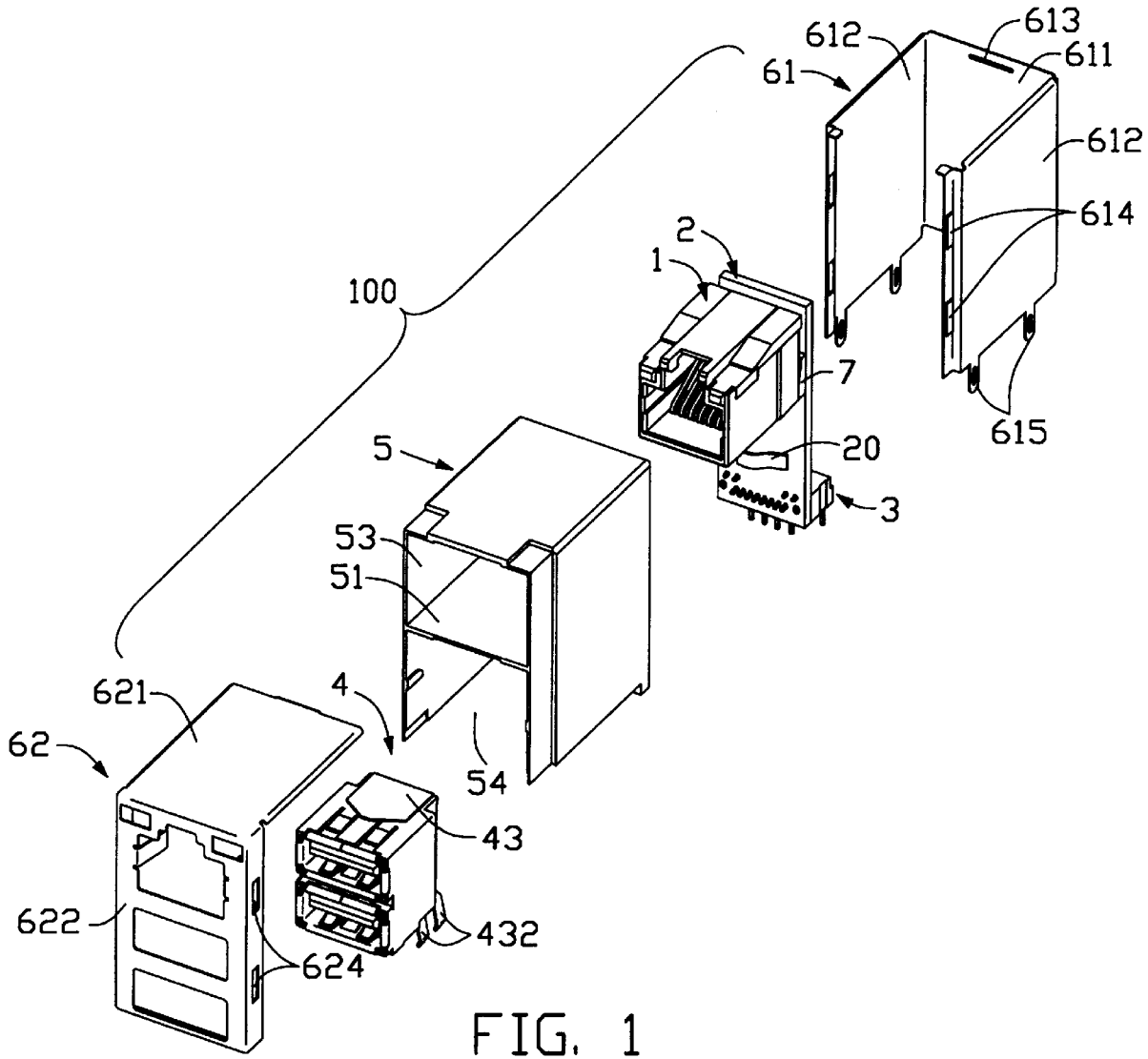
FIG. 1 is an exploded view of a modular jack in accordance with the present invention.
Figure 2:
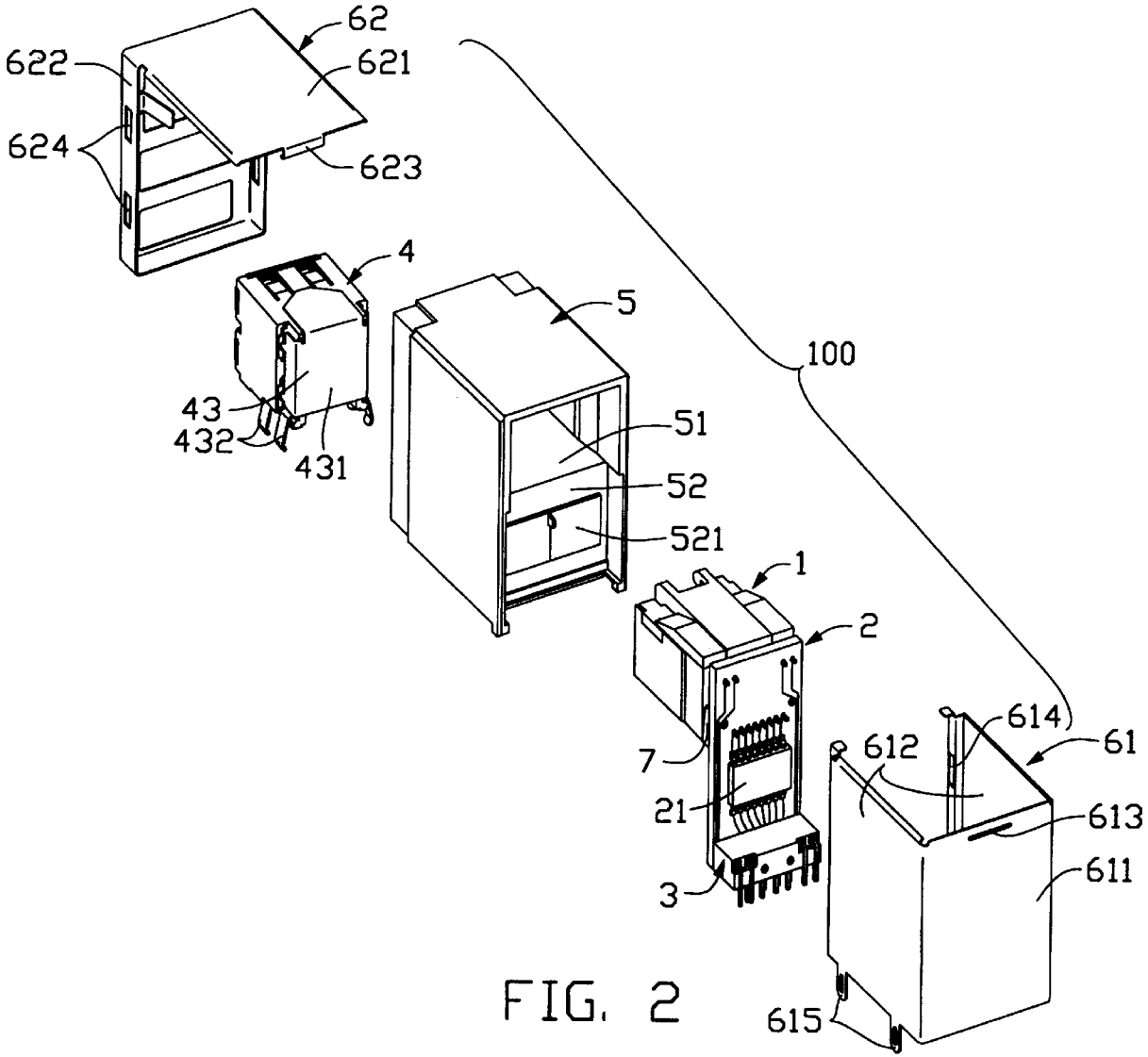
FIG. 2 is similar to FIG. 1 but taken from an opposite perspective.

Referring to FIGS. 1 and 2, a modular jack 100 in accordance with the present invention comprises a RJ45 connector 1, a daughter board 2 having an electronic component 21 mounted thereon, a transformer 3, a stacked USB connector 4, a dielectric frame 5 and first and second shields 61, 62. The RJ45 connector 1 and the transformer 3 are mounted on opposite surfaces of the daughter board 2 and distanced from each other, and are electrically connected via the electronic component 21. A pair of standoffs 7 is positioned between the daughter board 2 and the RJ45 connector 1 for adjusting the positional relationship between the daughter board 2 and the RJ45 connector 1. A grounding pad 20 made of metal is mounted on the same surface of the daughter board 2 as the RJ45 connector.

The stacked USB connector 4 includes a grounding shell 43 mounted on a rear portion thereof. The grounding shell 43 forms two pairs of legs 432 downwardly extending from an edge thereof for being electrically connected to a printed circuit board (not shown). The frame 5 is substantially U-shaped and forms a horizontal partition 51 and a vertical partition 52. The frame 5 defines a first space 53 and a second space 54 separated by the horizontal partition 51 for receiving the RJ45 connector 1 and the stacked USB connector 4, respectively. The vertical partition 52 defines a slot 521 through which the grounding pad 20 extends to contact a rear portion 431 of the grounding shell 43. The first shield 61 comprises a rear plate 611 and a pair of side plates 612. The rear plate 611 defines a slit 613 proximate a top edge thereof. Each side plate 612 forms a pair. of bosses 614 laterally stamped from a front edge thereof and a pair of tails 615 downwardly extending from a bottom edge thereof for being electrically connected to the printed circuit board. The second shield 62 comprises a top plate 621 and a front plate 622. The top plate 621 forms a hook 623 downwardly extending from a rear edge thereof in compliance with the slit 613 of the first plate 61. The front plate 622 defines a pair of cutouts 624 in each opposite side edge thereof in compliance with the bosses 614 of the first plate 61.

Figure 3:
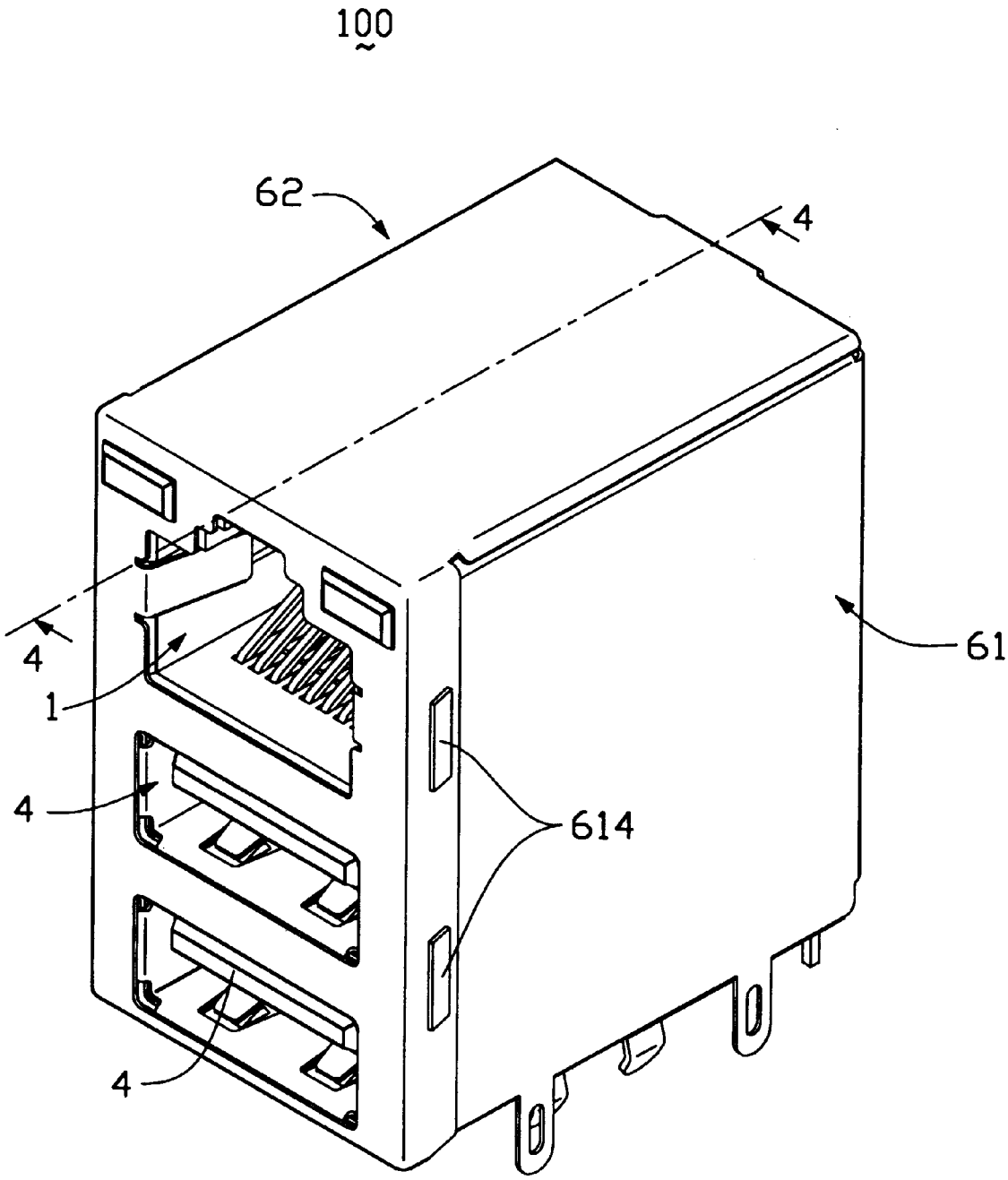
FIG. 3 is a perspective view of the assembled modular jack of FIG. 1.
Figure 4:
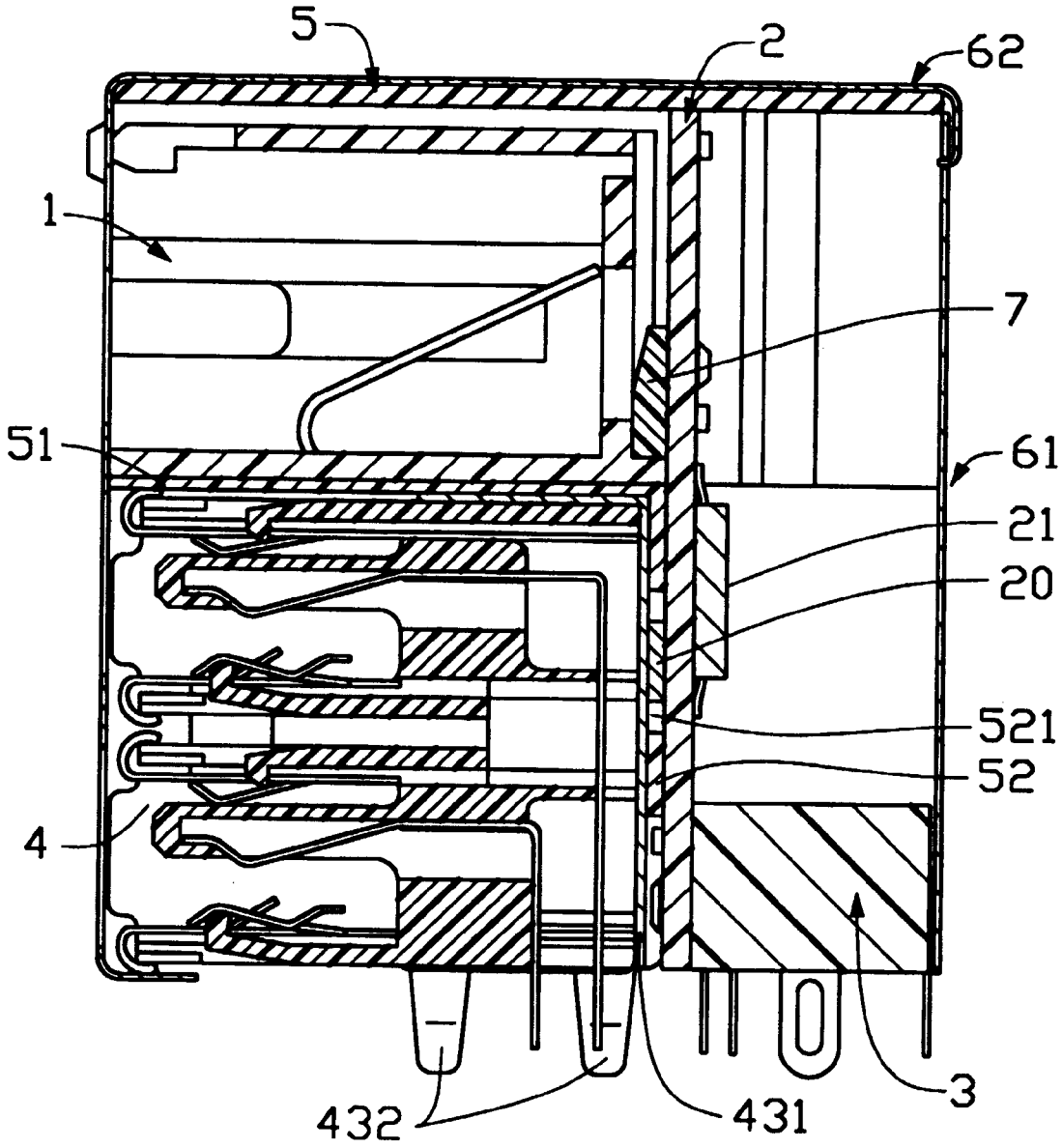
FIG. 4 is a cross-sectional view taken along line 4—4 of FIG. 3.

Also referring to FIGS. 3 and 4, in assembly, the RJ45 connector 1 together with the daughter board 2 and the transformer 3 are forwardly assembled to the frame 5 whereby the RJ45 connector 1 is received in the first space 53 of the frame 5, the daughter board 2 abuts against the vertical partition 52, and the grounding pad 20 extends through the slit 521 of the vertical partition 52. The stacked USB connector 4 is rearwardly assembled to the frame 5 and received in the second space 54 of the frame 5 whereby the rear portion 431 of the grounding shell 43 electrically abuts against the grounding pad 20. Furthermore, the first and second shield 61, 62 are forwardly and rearwardly assembled to the frame 5, respectively. The hook 623 of the second shield 62 is received in the slit 613 of the first shield 61 and the cutouts 624 of the second shield 62 receive the corresponding bosses 614 of the first shield 61 thereby securely engaging the first and second shield 61, 62 together. By such a configuration, the modular jack 100 effectively overcomes the shortcomings of the conventional modular jack.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a dielectric frame including a partition dividing said frame into first and second spaces;

a daughter board assembled to a rear portion of said frame and having a first connector assembled thereon received in said first space;

a grounding element mounted on the same surface of the daughter board as the first connector;

a second connector having a grounding shell mounted on a rear portion thereof, the second connector being received in the second space of the frame, the grounding shell being electrically connected with the grounding element; and first and second metal shields enclosing the frame and the daughter board to provide EMI Shielding to the first and second connectors;

wherein the frame forms a vertical partition proximate the rear portion thereof, the vertical partition defining a slot through which the grounding element extends to connect with the grounding shell;

further comprising a standoff positioned between the daughter board and the first connector to adjust the positional relationship between the daughter board and the first connector;

wherein the first shield comprises a rear plate and a pair of side plates, the rear plate defining a slit proximate a top edge thereof, each side plate forming a pair of bosses proximate an edge thereof distanced from the rear plate;

wherein the second shield comprises a top plate and a front plate, the top plate forming a hook downwardly extending from an edge thereof distanced from the front plate, the front plate defining a pair of cutouts in each opposite side edge thereof, the hook being received in the slit and the cutouts receiving the corresponding bosses to maintain the first and second shields together;

wherein the first connector is an RJ45 connector and the second connector is a stacked USB connector.

* * * * *